US006086048A

United States Patent [19]

Owen

[11] Patent Number: 6,086,048

[45] Date of Patent: Jul. 11, 2000

[54] BOARD PULLER

[76] Inventor: William D. Owen, 578 W. Main, Apt.5, Kahoka, Mo. 63445

[21] Appl. No.: 09/152,154

[22] Filed: Sep. 11, 1998

[51] Int. Cl.[7] ..... B66F 3/00

[52] U.S. Cl. ..... 254/17; 254/129

[58] Field of Search ..... 254/15–17, 131, 254/25, 129, 130; 29/239

[56] References Cited

U.S. PATENT DOCUMENTS

| | | | |
|---|---|---|---|
| 1,501,776 | 7/1924 | Hoffman . | |
| 1,781,833 | 11/1930 | Cummer . | |
| 2,910,271 | 10/1959 | Keehn | 254/129 |
| 3,134,573 | 5/1964 | Bizjak . | |
| 3,973,315 | 8/1976 | Thanghe | 29/239 |
| 5,139,231 | 8/1992 | Temple . | |
| 5,165,659 | 11/1992 | L'Heureux . | |
| 5,190,266 | 3/1993 | Barrera . | |
| 5,325,576 | 7/1994 | Henderson . | |

FOREIGN PATENT DOCUMENTS

| | | |
|---|---|---|
| 535996 | 1/1956 | Canada . |

*Primary Examiner*—Robert C. Watson
*Attorney, Agent, or Firm*—Richard Grundstrom

[57] ABSTRACT

A board puller for removing boards on a structure generally having a board cue which contacts the back side of boards to be removed, a fulcrum with a pivot that interacts with the frame structure and a handle for providing leverage. The board cue is pivotally attached towards one end of the fulcrum. The handle is rigidly attached to the other end of the fulcrum, but made so that the angle can be adjusted, in the preferred embodiment. In the center of the fulcrum is a pivot typically consisting of a curved or semi-circular member extending perpendicular for the fulcrum. Gauges are provided which are attached to the board cue. The gauges positions and holds the board cue on the boards being removed. This provides a means to remove the board in such a manner that splintering and board breakage is minimized. The board puller can be used with or without the gauges. In operation, the board cue is positioned behind the boards to be pulled or removed. The pivot on the fulcrum is positioned on the stud, joist or other frame structure on which the boards are nailed or screwed. The handle is then either pulled or pushed to remove the boards from the structure. The handle angle can be adjusted to provide the best angle for applying leverage.

17 Claims, 4 Drawing Sheets

BOARD PULLER

BACKGROUND OF THE INVENTION

The present invention relates to a board puller and more particularly to an apparatus used to remove boards and other structural materials from studs, joists or other framing structures.

During demolition and remodeling it is often necessary to remove the old lumber from wall studs, floor joists or other types of framing structures. The lumber could be in the form of dimensioned lumber, plywood or any other type of building material nailed or screwed onto the framing structure. Typically, a crow bar and a heavy hammer, a wrecking bar or other demolition type tools were used.

Most of the previous tools were time consuming, presented hazards to the craftsman and resulted in destruction of the wood or building material being removed. A crow bar or wrecking bar has to be moved from position to position and pried at several locations to remove the material. This takes a considerable time. As the material is pried outward, the material typically breaks, splinters, cracks or splits. If the lumber is firmly attached, its also difficult to get the crow bar or wrecking bar under the material. Once you get it in place and begin prying, the edge often breaks.

Prying off with crow bars, wrecking bars or hammers also causes piece to "fly" from the structure, making it a hazard. In addition, the broken lumber or material has to be piled or removed as the material is pulled or removed from the framing structure. The broken piece presents a serious hazard to the craftsman.

It is often true that the old lumber is salvageable and can be used for other purposes. Using wrecking or crow bars most often results in the destruction of the material being removed. Thus, it is rendered useless.

The board puller of this invention addresses these concerns and problems.

Accordingly, it is an object of the present invention to provide a board puller adapted to removed boards, lumber, plywood or other building materials from a framing structure. With the board puller of this invention it has been found that flooring and wall coverings is quickly and easily removed without the need of wrecking or crow bars and hammers.

Another object of the present invention is to provide a board puller constructed to remove lumber, boards, plywood and other building material with a minimum amount of damage to the material being removed. It has been demonstrated that the board puller of this invention can remove or pull boards from wall and floors without excessive splintering, splitting, cracking or breaking resulting in salvaged material which is reusable. This is mainly due to applying force to the material at an angle and position most conducive to the removal without damage.

A further object of the present invention is to provide a board puller that is adapted to be used in a variety of different situations. The board puller of this invention can be used in horizontal or vertical positions and can be used on flooring, walls, ceiling or any other position, with almost any type of material nailed or screwed to the frame.

Still another object of the present invention is to provide a board puller that will save time for the craftsman. The board puller of this invention removes boards or other building materials from framing structure very rapidly, as later described. As such, there is a very significant time saving, versus the old method of using bars, hammers, wreckers or any other method. The board puller can remove boards almost as fast as the board puller can be moved from position to position.

Still a further object of the present invention is to provide a board puller adapted to reduce hazards to the craftsman. The board puller of this invention is characterized by its ability to remove boards, lumber, plywood and other building materials without splintering, cracking, splitting or breaking. Thereby, reducing the hazard to the craftsman. In addition, the board puller reduces the likelihood of flying debris making it an overall safer environment for the craftsman.

These and other objects and features of the present invention will be better understood and appreciated from the following detailed description of the main embodiment thereof, selected for purposes of illustration and shown in the accompanying drawings.

SUMMARY OF THE INVENTION

To accomplish the foregoing and other objects of this invention there is provided a board puller 10 and more particularly to a board puller that uses a fulcrum 18 and a handle 20 to best utilize leverage between the board and underlaying frame structure to remove boards during remodeling or demolition.

The board puller 10 of this invention is utilized for removing boards, lumber, plywood or other building material from a framing structure. In a most basic description, the board puller has a board cue 12 which contacts the back side of boards or material to be removed; a fulcrum 18, with a pivot 22, interacts with the frame structure; and a handle 20 provides leverage to remove the material from the framing structure. The board cue 12 is pivotally attached to the fulcrum 18. The handle 20 is rigidly attached to an end opposite of the board cue 12. At a center location of the fulcrum 18 is a pivot 22. The pivot 22 contacts and applies pressure to the frame structure. Gauges 24 and 26 are provided and are attached to the ends of the board cue 12. Gauges 24 and 26 positions and holds the board cue 12 more exact on the boards being removed. This provides a means to remove boards with no or minimum splintering and board breakage. The board puller 10 can be used without the gauges 24 and 26, if the boards being removed are being scrapped.

In operation, the board cue 12 is positioned behind the boards to be pulled or removed. The pivot 22 on the fulcrum 18 is positioned on the stud, joist or other frame structure on which the boards are nailed or screwed. The handle 20 is then either pulled or pushed, depending on the situation, to remove the boards from the structure. The handle angle can be adjusted to provide the best angle for applying leverage. Using the board puller of this invention leverage is applied between the back side of the material being removed and the framing structure holding it.

DETAILED DESCRIPTION

Figure 1:
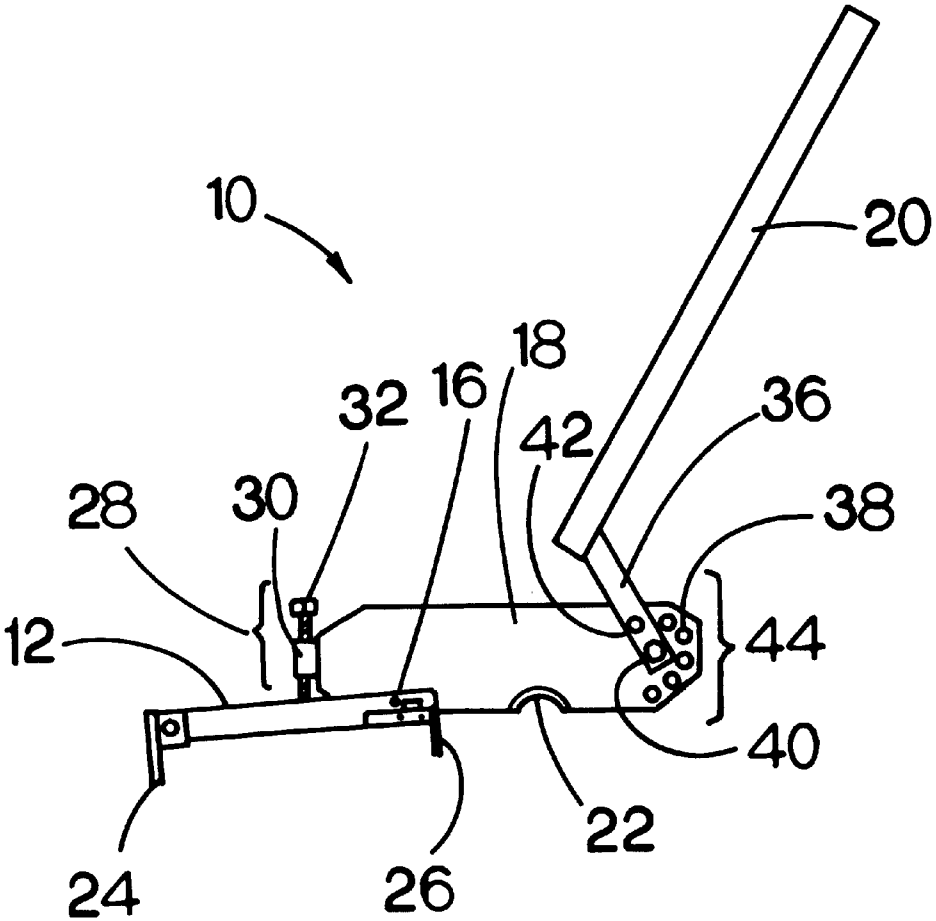
FIG. 1 is a side view showing the board puller of this invention.
Figure 3:
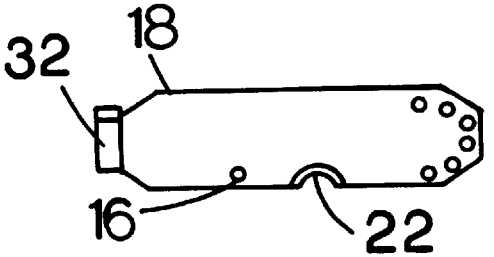
FIG. 3 is a side view of the fulcrum for the board puller.
Figure 4:
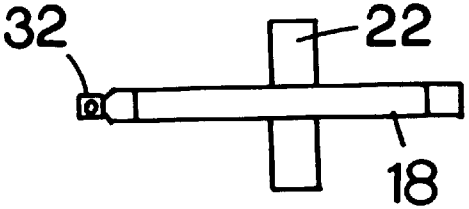
FIG. 4 is a top view of the fulcrum for the board puller and showing the pivot extending perpendicular outward from the fulcrum.
Figure 2:
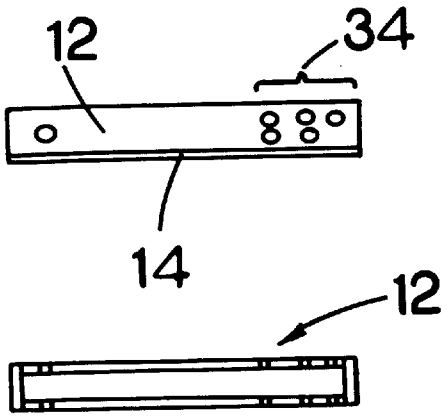
FIG. 2 is a side view of the board cue for the board puller.
Figure 5:
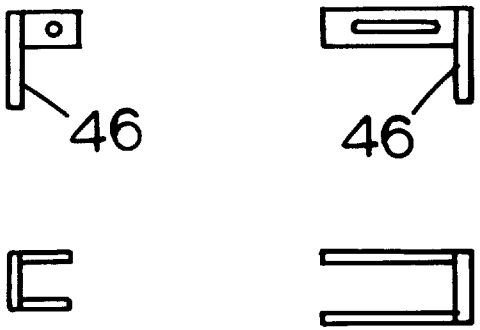
FIG. 5 is a combined top and side view of the gauges for the board puller.

Referring now to the drawings, there is shown the preferred embodiment for the board puller 10 of this invention. The preferred embodiment is considered the best mode contemplated and is only being illustrated and described in detail as such. The invention is generally described and claimed as well as the specific embodiment described. Limitations are not to be construed as being limited to the specific and preferred embodiment described and illustrated as the best mode contemplated. Rather limitation should be construed based upon the general descriptions and the appended claims.

The basic embodiment of the invention includes a board cue 12, a fulcrum 18, a pivot 22 and a handle 20. The board cue 12 is pivotally attached towards one end of the fulcrum 18. The handle 20 is rigidly attached to the other end of the fulcrum 18. The pivot 22 is located at an approximate center location on a lower edge on the fulcrum 18.

Gauges 24 and 26 are also provided and attach to the ends of the board cue 12. The gauges 24 and 26 positions and holds the board cue 12 more exact with the widths of the boards being removed.

Various means of adjustments to provide ultimate usage are also provided. There is a board cue adjustment means 28, a handle angle adjustment means 38 and a leverage adjusting means 34. These various adjustment means are further described below. These are optional over the basic embodiment, but will typically be included in the preferred embodiment and best mode contemplated described below.

The preferred embodiment and the best mode contemplated of the board puller of the present invention are herein described. However, it should be understood that the best mode for carrying out the invention hereinafter described is offered by way of illustration and not by the way of limitation. It is intended that the scope of the invention include all modifications which incorporate its principal design features.

A board cue 12, in the preferred embodiment, is made with steel plating. Typically, there will be two side plates, a bottom plate and two end plates. The side plates are rigid elongated panels joined with short end plates to form the basic board cue 12. The plates are typically joined together with a space between the two side plates. The space between the plates is sized to receive the fulcrum 18. The board cue 12 has a bottom surface, made with the bottom plate, forming an elongated surface 14 that engages or contacts one or more boards, lumber or other building material to be removed or pulled from a framing structure. An attachment means 16 is used to pivotally attach the board cue 12 to the fulcrum 18.

The attachment means 16 is located toward one end of the board cue 12 on the side plates perpendicular to the elongated surface 14. In a simple embodiment, the attachment means 16 is simply a hole bored through the two side plates on the board cue 12 and through the fulcrum 18 at a location between the pivot 22 and a first end of the fulcrum 18. A bolt or pivot pin extends through the holes in the board cue 12 and fulcrum 18 to pivotally join the board cue 12 to the fulcrum 18.

In the preferred embodiment as shown, the attachment means also incorporates a leverage adjustment means 34. The leverage adjustment means 34 provides a means of adjusting the leverage to be applied to the board cue 12 and the boards to be removed. The leverage adjustment means 34 is a series of holes or bores located adjacent to or around the hole of the attachment means 16 on the board cue 12. The various holes provide a means of attaching the board cue 12 to the fulcrum 18 in different positions. This controls the amount of leverage as pressure is applied through the fulcrum 18 by handle 20.

The fulcrum 18 is a central portion of the board puller 10, to which the major components are attached. The fulcrum 18, in the preferred embodiment, is basically a strong rigid elongated steel plate or member. The board cue 12 and the fulcrum 18 are pivotally attached by the attachment means 16, as indicated above.

The board cue angle adjustment means 28 provides a means of adjusting the angle between the board cue 12 and the fulcrum 18. The angle of the board cue 12 helps to maintain pressure at a proper angle across the width of the boards to be pulled or removed as pressure is applied. The board cue angle adjustment means 28, in the preferred embodiment, contains a threaded member 30, having a centrally located lateral threaded bore therethrough. The threaded member 30 is attached to a first end of the fulcrum 18. An adjustment bolt 32 is screwed through the threaded member 30 to provide the adjustment. The end of the adjustment bolt 32 contacts or engages the board cue 12 to control or limit the angle between the board cue 12 and the fulcrum 18. A lock nut could also be used to lock the adjustment bolt in position. An end cap could also be added to the end of the adjustment bolt 32 to protect the end of the adjustment bolt 32 from damage. However, these two features or elements are not shown or further described. It is considered that one skilled in the art could easily understand these features. A pivot 22 is located at a center location along one edge of the fulcrum 18. The pivot 22 interacts with the frame or framing structure on which the boards are attached. The fulcrum 18, and the board puller 10 in general, uses the pivot 22 to pivot on the frame or other frame structure. Additionally, pressure is exerted to the frame by the pivot 22 as the board puller 10 is operated. The pivot 22 generally consists of a rigid curved or semi-circular member extending outward perpendicularly from the fulcrum 18. The curve or semi-circle shape in the pivot 22 is preferred because it makes it easier to rotate or pivot the board puller 10 on the frame structure, stud or joist.

A handle 20 is attached to a second end of the fulcrum 18. The handle 20 provides all the leverage. The length of the handle 20 could be of any reasonable length and extensions could be added. Generally, the longer the handle 20 the less force or pressure is needed to remove or pull the boards. In the preferred embodiment, the handle is approximately fifty (50) inches but other lengths could also be used. The handle 20 is typically rigidly fastened to the second end of the fulcrum 18. In the basic embodiment, the handle 20 is simply bolted or welded as preferred. A bracket 36 may be used, as shown, at the end of the handle 20 for ease of attaching the handle 20 to the fulcrum 18. Bolts, in the preferred embodiment, are used to attach or fasten the handle to the fulcrum 18 through appropriately located bores.

Figure 6:
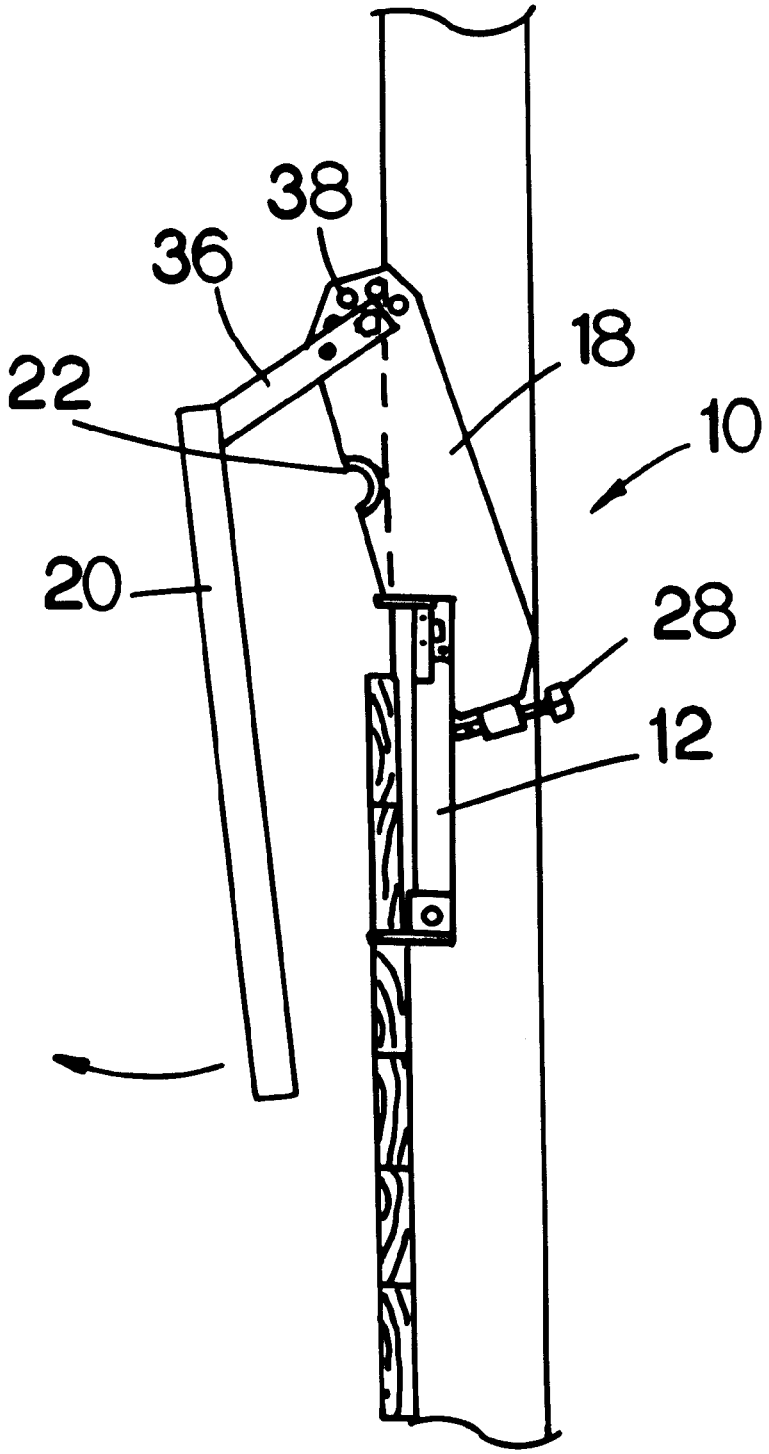
FIG. 6 is showing the board puller being used on a wall structure and the leverage being applied by a pulling action on the handle.
Figure 7:
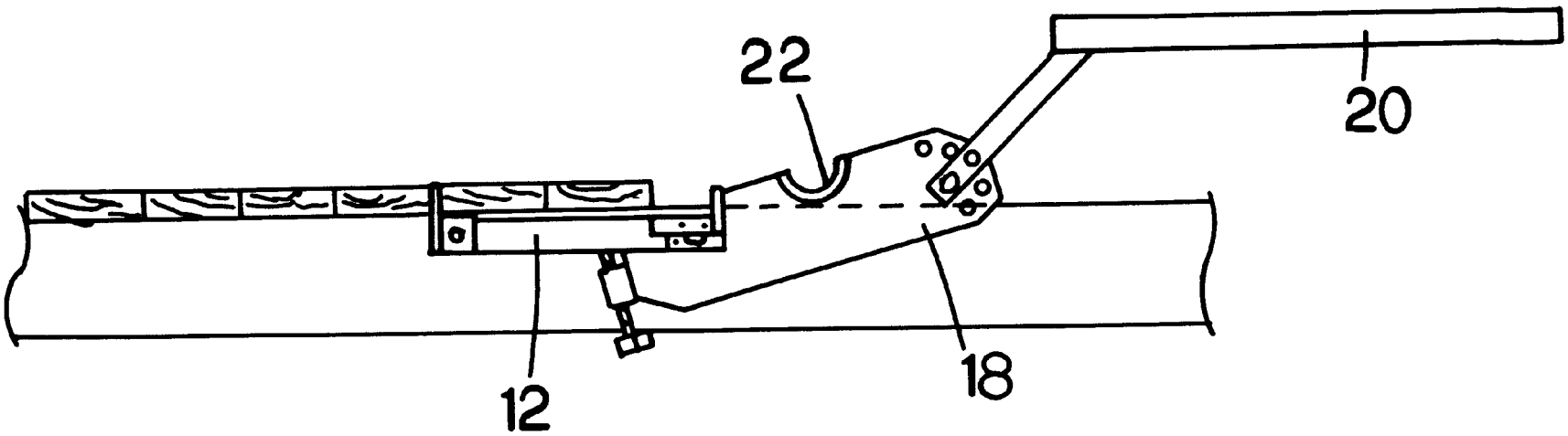
FIG. 7 is showing the board puller being used on a floor structure and the leverage being applied by a push down action on the handle.

In the preferred embodiment, there is a handle angle adjustment means 38. The handle angle adjustment means 38 provides a means of adjusting the angle between the fulcrum 18 and the handle 20. The handle adjustment means 38 is desired, because of the various applications and positioning of the board puller 10. In some situations, with the proper angle, the handle 20 is pulled, as shown in FIG. 6. In other situations, with the proper angle, the handle 20 is pushed as shown in FIG. 7. Without the handle angle adjustment means 38 the board puller 10 would be generally fixed for a particular situation.

The handle angle adjustment means 38 is located on the second end of the fulcrum 18. In the preferred embodiment, the handle angle adjustment means 38 includes the bracket 36 on handle 20; the bracket 36 containing a pivot bore 40 and a locking bore 42; and a series of adjustment bores 44 located in an arch or curve around a center bore along the second end of the fulcrum 18. A pivot pin or bolt is inserted through the pivot bore 40 on bracket 36 and the center bore on the fulcrum 18 to pivotally attach the handle 20 to the fulcrum 20. Adjustment of the angle between the handle 20 and the fulcrum 18 is then adjusted by pivoting or rotating the handle 20 until the locking bore 42 is aligned with one of the adjustment holes 44. The handle is then locked in position by a locking pin or bolt inserted in the aligned locking bore 42 and adjustment hole 44.

Gauges 24 and 26 are also included. The gauges 24 and 26 are attached to the ends of the board cue 12. The gauges 24 and 26, in a simple form, are angle brackets made to fit the ends of the board cue 12. The gauges 24 and 26 have projections 46 extending perpendicular from board cue 12. The projections 46 are installed over the edges of the boards to be pulled or removed. The projections prevents the board cue 12 from moving during operation. The main leg of the gauges 24 and 26 are simply bored and bolted to the ends of board cue 12. An adjustment slot 48 may be provided on one or both of the gauges 24 and 26 to allow adjustment for different size boards. Typically, the gauges 24 and 26 are also made of steel plates. The gauges 24 and 26 help to protect the board being pulled from splintering or excessive damage. This is due to the exact fit of the board cue 12 to board and the elimination or limitation of movement of the board cue 12 on the boards as leverage is applied. The use of the gauges is completely optional. Typically, if the boards being removed are to be scraped, the gauges will not be used. If the boards are to be salvaged the gauges should be used.

In operation the board cue 12 is positioned behind the boards to be pulled or removed. This is generally accomplished by inserting the board cue 12 between the studs or joists. An opening may have to be made first. If the gauges are used, the projections 46 will be fitted over the edges of the boards. The pivot 22, on fulcrum 18, is positioned on the stud, joist or other frame structure on which the boards are nailed or screwed. The handle 20 is then either pulled or pushed to remove the boards from the structure.

The handle angle can be adjusted to provide the best angle for applying leverage. The leverage adjusting means 34 and the board cue angle adjustment means are adjusted to provide the maximum leverage, based upon the type and size of material being removed. The board puller 10, in use, maximizes the pressure or leverage being applied to the board cue 12 by the board puller 10 pivoting on pivot 22 and applying pressure to the frame. As such, the board puller 10 exerts an extreme amount of pressure between the boards and the frame. Ideally, the pressure exerted by board cue 12 applies pressure beginning at the top edge of the board and as the board begins to distance itself from the frame the pressure moves across the width of the board or boards. The angle of the pressure is adjusted by the board cue angle adjustment means 28. This pressure causes the nails to be pulled at an even rate and pressure. The nails will either be pulled from the framing structure or will be pulled through the board being pulled. Since the boards are removed in an ideal angle with even and constant pressure splintering, cracking, and breakage is minimized. In most cases there will be no damage other than that caused by the nail or screw.

Since the board are removed without splintering, breaking or cracking, the boards, lumber or other building can be easily carried without the fear of being poked or stabbed by pointed ends and without the fear of obtaining slivers from splintered wood. In addition, the boards can be neatly stacked for removal. There will not be a pile of broken, splintered and cracked boards or lumber that is hard to carry, which present hazards and dangers to the craftsman and results in waste material that has to be disposed of.

The board puller 10 is simply moved between studs or joist across the boards to be pulled and is operated as it is moved. The action at a single location may be removing one or more boards depending on the width of the boards and the size of the board cue 12. In some situations, the board puller 12 may be simply slid down the stud or along the joist in continuing operation. This would be determined by the specific application and whether the boards can be moved out of position and out of the way for the next operation. There is not a need to get down on hands and knees to pry the boards, one location after another, as with a crow bar or wrecking bar. All operations are from a standing position, which is considerable safer and faster.

As it can be seen, the board puller 10 of this invention saves time, provides a safer environment and results in used lumber or material that can be later used.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A board puller comprising:

a board cue having an elongated surface that engages one or more boards to be removed or pulled and an attachment means adjacent to the elongated surface;

a fulcrum being an elongated rigid member, the board cue being pivotally attached near a first end of the fulcrum by the attachment means;

a pivot at a center location along a lower edge of the fulcrum, the pivot interacting with a frame on which the boards are attached; and a handle attached to a second end of the fulcrum for providing leverage.

2. The board puller as set forth in claim 1 further comprises one or more gauges, the gauges attach to the board cue to limit movement of the board cue on boards or building material as they are being removed.

3. The board puller as set forth in claim 1 further comprises a board cue angle adjustment means attached to the fulcrum, the board cue angle adjustment means providing a means of adjusting the angle between the board cue and the fulcrum.

4. The board puller as set forth in claim 1 further comprises a handle angle adjustment means located on the fulcrum, the handle angle adjustment means providing a means of adjusting the angle between the fulcrum and the handle.

5. The board puller as set forth in claim 1 in which the pivot consists of a rigid curved member extending outward perpendicularly from the fulcrum.

6. The board puller as set forth in claim 3 in which the board cue adjustment means is a member with a center longitudinal threaded bore rigidly attached at a first end of the fulcrum, and an adjusting bolt that is threaded through the center bore; the end of the adjusting bolt contacting the board cue to adjust the angle between the fulcrum and the board cue.

7. The board puller as set forth in claim 4 in which said handle angle adjustment means comprises a plurality of bores in a curved relation around a center bore along the second end of the fulcrum, a bracket at an end of the handle pivotally attached to the center bore, and a locking means extending through a hole in the bracket and through one of the plurality of bores, the locking means locking the handle at an angle determined by which one of the plurality of bores is selected.

8. The board puller as set forth in claim 7 in which the locking means is a bolt and nut.

9. The board puller as set forth in claim 1 further comprising a leverage adjusting means, the lever adjusting means providing a means to adjust the leverage of the board cue as acted upon by the fulcrum.

10. The board puller as set forth in claim 9 in which the leverage adjusting means comprises a series of leverage adjustment holes through the board cue, leverage is adjusted by mounting the board cue to the fulcrum on one of the different leverage adjusting holes.

11. A board puller comprising:

a board cue having an elongated surface that engages one or more boards to be removed or pulled and an attachment means on an opposite side of the elongated surface;

a fulcrum being an elongated member pivotally attached to the attachment means on the board cue;

a board cue angle adjuster attached to the fulcrum, the board cue angle adjuster providing a means of adjusting the angle between the board cue and the fulcrum;

a pivot at a center location along one edge of the fulcrum, the pivot interacts with a frame on which the boards are attached;

a handle adjustably attached to a second end of the fulcrum for providing leverage; and a handle angle adjuster located on the fulcrum, the handle angle adjuster providing a means of adjusting the angle between the fulcrum and the handle.

12. The board puller as set forth in claim 11 further comprises one or more gauges, the gauges attach to the board cue to limit movement of the board cue on boards or building material as they are being removed.

13. The board puller as set forth in claim 11 in which the board cue adjuster comprises a member with a threaded center bore rigidly attached at a first end of the fulcrum and an adjusting bolt that is threaded through the center bore; the end of the adjusting bolt contacting the board cue to adjust the angle between the fulcrum and the board cue.

14. The board puller as set forth in claim 11 in which the handle angle adjuster comprises a plurality of bores in a curved relation around a center bore along the second end of the fulcrum, a bracket at an end of the handle pivotally attached to the center bore, and a locking means extending through a hole in the bracket and through one of the plurality of bores, the locking means locking the handle at an angle determined by which one of the plurality of bores is selected.

15. The board puller as set forth in claim 11 further comprising a leverage adjusting means, the lever adjusting means providing a means to adjust the leverage of the board cue as acted upon by the fulcrum.

16. The board puller as set forth in claim 15 in which the leverage adjusting means comprises a series of leverage adjustment holes through the board cue, leverage is adjusted by mounting the board cue to the fulcrum on one of the different leverage adjusting holes.

17. A board puller comprising:

a board cue having an elongated surface that engages one or more boards to be removed or pulled and an attachment means on an opposite side of the elongated surface;

a fulcrum being an elongated member pivotally attached to the attachment means on the board cue;

a board cue angle adjuster attached to the fulcrum, the board cue angle adjuster providing a means of adjusting the angle between the board cue and the fulcrum, the board cue adjuster consisting of a member with a threaded center bore rigidly attached at a first end of the fulcrum and an adjusting bolt that is threaded through the center bore; the end of the adjusting bolt contacting the board cue to adjust the angle between the fulcrum and the board cue;

a leverage adjusting means, the lever adjusting means providing a means to adjust the leverage of the board cue as acted upon by the fulcrum; the leverage adjusting means comprises a series of leverage adjustment holes through the board cue, leverage is adjusted by mounting the board cue to the fulcrum on one of the different leverage adjusting holes;

a pivot at a center location along one edge of the fulcrum, the pivot interacts with a frame on which the boards are attached, the pivot consisting of a curved or semicircular member extending perpendicularly from the fulcrum;

a handle adjustably attached to a second end of the fulcrum for providing leverage;

a handle angle adjuster located on the fulcrum, the handle angle adjuster providing a means of adjusting the angle between the fulcrum and the handle; the handle angle adjuster comprising a plurality of bores in a curved relation around a center bore along the second end of the fulcrum, a bracket at an end of the handle pivotally attached to the center bore, and a locking means extending through a hole in the bracket and through one of the plurality of bores, the locking means locking the handle at an angle determined by which one of the plurality of bores is selected; and one or more gauges, the gauges attach to the board cue to limit movement of the board cue on boards or building material as they are being removed.

* * * * *